US005659664A

United States Patent [19]

Kaja

[11] Patent Number: 5,659,664

[45] Date of Patent: Aug. 19, 1997

[54] SPEECH SYNTHESIS WITH WEIGHTED PARAMETERS AT PHONEME BOUNDARIES

[75] Inventor: Jaan Kaja, Haninge, Sweden

[73] Assignee: Televerket, Farsta, Sweden

[21] Appl. No.: 468,640

[22] Filed: Jun. 6, 1995

Related U.S. Application Data

[63] Continuation of Ser. No. 222,336, Apr. 4, 1994, abandoned, which is a continuation of Ser. No. 16,075, Feb. 10, 1993, abandoned.

[30] Foreign Application Priority Data

Mar. 17, 1992 [SE] Sweden ..... 9200817

[51] Int. Cl.[6] ..... G10L 5/04

[52] U.S. Cl. ..... 395/2.74; 395/2.76

[58] Field of Search ..... 395/2.76, 2.67, 395/2.69, 2.74

[56] References Cited

U.S. PATENT DOCUMENTS

| | | | |
|---|---|---|---|
| 4,039,754 | 8/1977 | Lokerson | 381/50 |
| 4,344,343 | 8/1982 | Deforeit | 84/607 |
| 4,601,052 | 7/1986 | Saito et al. | 395/2.74 |
| 4,852,168 | 7/1989 | Sprague | 381/34 |
| 4,896,359 | 1/1990 | Yamamoto et al. | 381/52 |
| 4,908,867 | 3/1990 | Silverman | 381/52 |

*Primary Examiner*—Allen R. MacDonald
*Assistant Examiner*—Robert C. Mattson
*Attorney, Agent, or Firm*—Oblon, Spivak, McClelland, Maier & Neustadt, P.C.

[57] ABSTRACT

The invention relates to a method and an arrangement for speech synthesis and provides an automatic mechanism for simulating human speech. The method provides a number of control parameters for controlling a speech synthesis device. The invention solves the problem of coarticulation by using an interpolation mechanism. The control parameters are stored in a matrix or a sequence list for each polyphone. The behaviour of the respective parameter with time is defined around each phoneme boundary and polyphones are joined by forming a weighted mean value of the curves which are defined by their two associated matrices/sequences list. The invention also provides an arrangement for carrying out the method.

2 Claims, 2 Drawing Sheets

SPEECH SYNTHESIS WITH WEIGHTED PARAMETERS AT PHONEME BOUNDARIES

This application is a Continuation of application Ser. No. 08/222,336, filed on Apr. 4, 1994, now abandoned; which is a continuation of Ser. No. 08/016,075, filed Feb. 10, 1993, now abandoned.

BACKGROUND OF THE INVENTION

The present invention relates to a method and an arrangement for speech synthesis and provides an automatic mechanism for simulating human speech. The method according to the present invention provides a number of control parameters for controlling a speech synthesis device.

In natural speech, the phonemes contained therein overlap one another. This phenomenon is called coarticulation. The present invention combines diphonic synthesis and formant synthesis for handling coarticulation. Furthermore, the present invention provides the possibility for polyphonic synthesis, especially diphonic synthesis, but also triphonic synthesis and quadraphonic synthesis.

It is known that the synthesis of text and/or speech often starts with a syntactic analysis of the text in which words, which are capable of being interpreted in more than one way, are given a correct pronunciation, that is to say, a suitable phonetic transcription is selected. An example of this is the Swedish word "buren" which can be interpreted as a noun, or as the participle form of a verb.

By using syntactic analysis and the syllabic structure of the sentence as a starting point, a fundamental sound curve can be created for the whole phrase and the durations of the phonemes contained therein can be determined. After this process, the phonemes can be realised acoustically in a number of different ways.

A known method of speech synthesis is formant synthesis. With this method, the speech is produced by applying different filters to a source. The filters are controlled by means of a number of control parameters including, inter alia, formants, bandwidths and source parameters. A prototype set of control parameters is stored by allophone. Coarticulation is handled by moving start/end points of the control parameters with the aid of rules, i.e. rule synthesis. One problem with this method is that it needs a large quantity of rules for handling the many possible combinations of phonemes. Furthermore, the method is difficult to survey.

Another known method of speech synthesis is diphonic synthesis. With this method, the speech is produced by linking together segments of recorded wave forms from recorded speech, and the desired basic sound curve and duration is produced by signal processing. An underlying prerequisite of this method is that there is a range which is spectrally stationary, in each diphone, and that spectral similarity prevails there; otherwise, a spectral discontinuity is obtained there, which is a problem. It is also difficult with this method to change the waveforms after recording and segmentation. It is also difficult to apply rules since the waveform segments are fixed.

There are no problems with spectral discontinuities in formant speech synthesis. Diphonic speech synthesis does not need any rules for handling the coarticulation problem.

It is an object of the present invention to use a diphonic synthesis method, that is to say, the use of stored control parameters which have been extracted by copying natural speech with the aid of synthesis, for generating speech by means of formant synthesis. An interpolation mechanism automatically handles coarticulation. If it is nevertheless desirable to apply rules and this can, in fact, be done.

SUMMARY OF THE INVENTION

The invention provides a method for speech synthesis including the steps of determining the parameters required for controlling the synthesis of speech; storing the control parameters for each polyphone; defining the behaviour of the respective parameter with respect to time around each phoneme boundary; and joining the polyphones by forming a weighted mean value of the curves which are defined by their respective stored control parameters.

In the foregoing method, the control parameters can be stored in a matrix or a sequence list for each polyphone.

The invention also provides an arrangement for forming synthetic sound combinations within selected time intervals, wherein one or a number of sound-producing organs produce sound creations of the said sound combinations, wherein one or a number of control elements are arranged for causing action on the said sound-producing organ for forming sound combinations within the time intervals, wherein the effects of such action cause a transition within the respective time intervals affected, in which two diphones can occur, between a first representation of a sound characteristic for a second phoneme included in a first diphone, and a second representation of a sound characteristic for a first phoneme included in a second diphone, and wherein the first representation passes essentially without discontinuity, preferably continuously, into the second representation.

With the above arrangement, the respective control element can be arranged to collect and store parameter samples of the sound characteristics from an affected phoneme belonging to an affected diphone.

The foregoing and other features according to the present invention will be better understood from the following description with reference to the.

FIG. 1 of the accompanying drawings which is a diagram illustrating the joining of two diphones in accordance with the present invention.

FIG. 2 is a simplified flow chart of applicants' methodology.

DESCRIPTION OF THE PREFERRED EMBODIMENTS OF THE INVENTION

Figure 1:
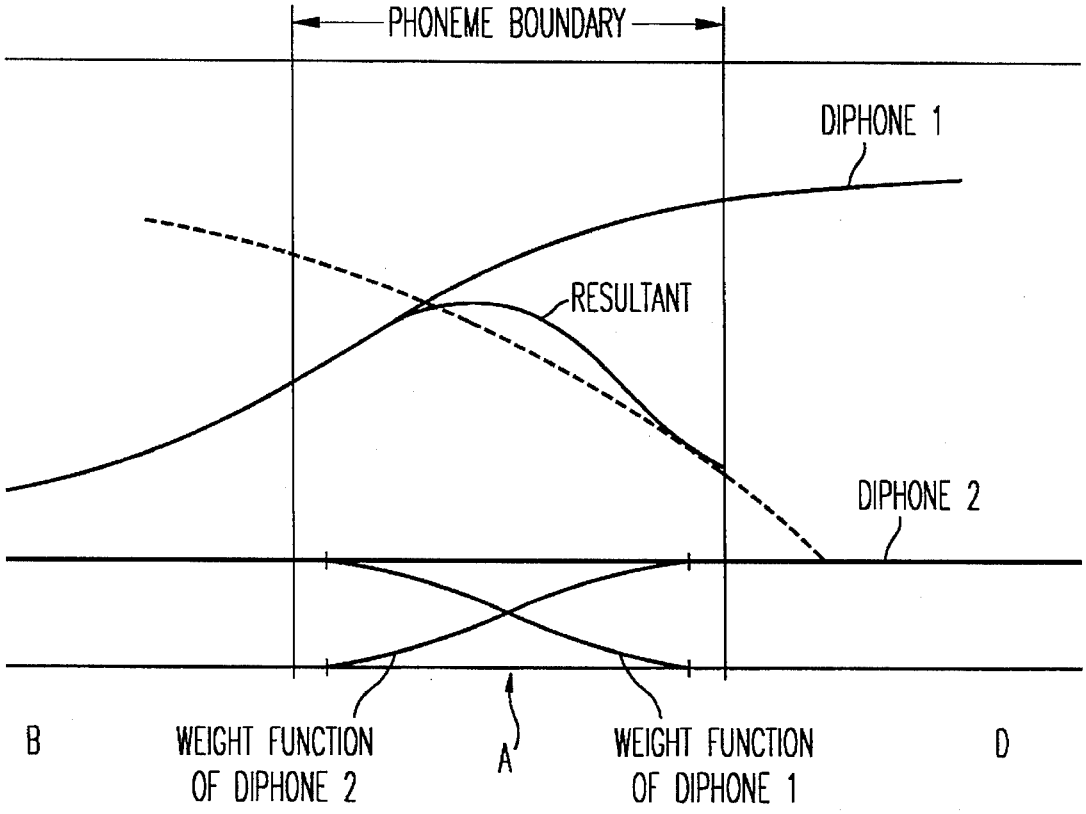

Natural human speech can be divided into phonemes. A phoneme is the smallest component with semantic difference in speech. A phoneme can be realised per se by different sounds, allophones. In speech synthesis, it must be determined which allophone should be used for a certain phoneme, but this is not a matter for the present invention.

There is a coupling between the different parts in the speech organ, for example, between the tongue and the larynx, and the articulators, tongue, jaw and so forth, cannot be instantaneously moved from one point to another. There is, therefore, a strong coarticulation between the phonemes; thus the phonemes affect each other. To obtain speech which is true to nature from a speech synthesis device, it must, therefore, be capable of handling coarticulation.

The present invention also provides for polyphone speech synthesis, that is to say, the interconnection of several phonemes, for example, triphone synthesis, or quadrophone synthesis. This can be effectively used with certain vowel sounds which do not have any stationary parts suitable for joining. Certain combinations of consonants are also troublesome. In natural human speech, there is always movement somewhere, and the next sound is anticipated. For example, in the word "sprite", the speech organ is formed for the vowel before the "s" is pronounced. By storing in the triphone as points along a curve, the triphone can be linked together with the subsequent phoneme.

The waveform of the speech can be compared with the response from a resonance chamber, the voice pipe, to a series of pulses, quasiperiodic vocal chord pulses in voiced sound or sounds generated with a constriction in unvoiced sounds. In speech prediction, the voice pipe constitutes an acoustic filter where resonance arises in the different cavities which are formed in this context. The resonances are called formants and they occur in the spectrum as energy peaks at the resonance frequencies. In continuous speech, the formant frequencies vary with time since the resonance cavities change their position. The formants are, therefore, of importance for describing the sound and can be used for controlling speech synthesis.

A speech phrase is recorded with a suitable recording arrangement and is stored in a medium which is suitable for data processing. The speech phrase is analyzed and suitable control parameters (S1 in FIG. 2) are stored according to one of the methods outlined below.

The storage (S2 in FIG. 2) of the Control parameters referred to above can be effected by either of the following methods:

(1) A matrix is formed in which each row vector corresponds to a parameter and the elements in this correspond to the sampled parameter values. (Typical sampling frequency is 200 Hz). This method is suitable for diphone synthesis.

(2) A sequence of mathematical functions, start/end values+function, is formed for each parameter. This method is suitable for polyphone synthesis and makes it possible to use rules of the traditional type, if desired.

One method of producing stored control parameters which provide good synthesis quality, is to carry out copying synthesis of a natural phrase. With this arrangement, numeric methods are used in an iterative process which, by stages, ensures that the synthetic phrase more and more resembles the natural phrase. When a sufficiently good likeness has been obtained, the control parameters which correspond to the desired diphone/polyphone, can be extracted from the synthetic phrase.

According to the invention, the coarticulation is handled by combining formant synthesis with diphone synthesis. Thus, a set of diphones is stored on the basis of formant synthesis. For each parameter, a curve is defined in accordance with either method (1) or method (2), as outlined above, which describes the behaviour of the parameter with time around the phoneme boundary "phoneme boundary" in FIG. 1, and S3 in FIG. 2).

Two diphones are joined together (S4 in FIG. 2 ) by forming a weighted mean value (Resultant in FIG. 1) between the second phoneme in the first diphone and the first phoneme is the second diphone.

The single figure of the accompanying drawings shows the linking mechanism according to the present invention in detail. The curves illustrate one parameter, for example, the second formant for the two diphones. The first diphone can be, for example, the sound "ba" and the second the sound "ad", which, when linked together, become "bad". The curves proceed asymptotically towards constant values to the left and right.

In the centre phoneme, an interpolation mechanism is in operation. The two diphone curves are weighted each with its own weight function ("weight function of diphone 2" and "weight function of diphone 1"in FIG. 1), which is shown at the bottom of the single figure of the drawings. The weight functions are preferably cosine functions in order to obtain a smooth transition, but this is not critical since linear functions can also be used.

Certain areas are not interpolated since certain speech sounds, such as stop consonants, involve a pressure being build up in the mouth cavity which is then released, for example "pa". The process from the time at which the pressure is released until the vocal chord pulses are produced, is purely mechanical and is not affected appreciably by the remaining length of the phoneme in the phrase. Should the duration of the stop consonant be extended, it is the silent phase which becomes longer. The interpolation mechanism must, therefore, avoid extending certain bits. Around the segment boundaries, it is, therefore, necessary for certain bits to have a fixed length, that is to say, the application of the weight function begins one bit after the segment boundary and ends one bit before the segment boundary.

It is the syntactic analysis which determines how a phrase will be synthesised. Among others, the fundamental sound curve and duration of the segments are determined, which provides different emphasis, among others. The emphasis is produced, for example, by stretching out the segment and a bend in the fundamental sound curve whilst the amplitude has less significance.

According to the invention, the segments can have different durations, that is to say, length in time. The segment boundaries are determined by the transition from one phoneme to the next whilst the syntactic analysis determines how long a phoneme shall be. Each phoneme has an aesthetic value. According to the invention, the curves or the functions can be stretched for matching (S5 in FIG.2) two durations to one another. This is done by quantizing for a ms interval and manipulating the curves. This is also facilitated by the curves being asymptotic to infinity.

Figure 2:
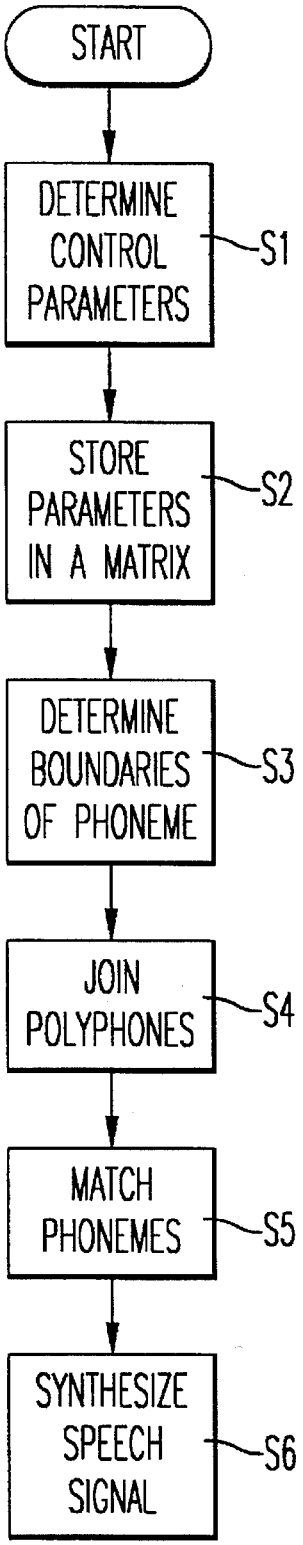

The method according to the present invention provides control parameters which can be directly used in a conventional speech synthesis machine (S6 in FIG. 2). The present invention also provides such a machine. By combining formant speech synthesis with diphone speech synthesis according to the present invention, a more true-to-nature speech is thus obtained because the formant synthesis provides soft curves which are joined without any discontinuities.

We claim:

1. A method of speech synthesis comprising the steps of:

determining a set of control parameters required for the control of the synthesis of the speech;

storing said control parameters in either a matrix or as a sequence list of each polyphone;

defining a behavior of a given control parameter with respect to a time period around each phoneme boundary;

weighting each of said matrix or sequence list by an individual weight function;

forming a weighted mean value for joining polyphones by multiplication by a cosine function;

joining polyphones by use of said weighted mean values which are defined by associating two matrices or sequence lists;

matching a duration of each phoneme to a neighboring polyphone by quantizing the duration for one parameter sampling interval; and synthesizing a speech signal from said phonemes.

2. The method of speech synthesis as in claim 1, wherein the step of determining a set of control parameters further comprises:

a numerical analysis.

* * * * *